US006640839B2

(12) United States Patent
Thieme

(10) Patent No.: US 6,640,839 B2
(45) Date of Patent: Nov. 4, 2003

(54) ARRANGEMENT FOR BINDING OBJECTS BY MEANS OF A BAND LOOP

(75) Inventor: Hans-Dieter Thieme, Uetersen (DE)

(73) Assignee: Hellermann Tyton GmbH, Tornesch (DE)

( * ) Notice: Subject to any disclaimer, the term of this patent is extended or adjusted under 35 U.S.C. 154(b) by 0 days.

(21) Appl. No.: 10/073,517

(22) Filed: Feb. 11, 2002

(65) Prior Publication Data

US 2002/0108665 A1 Aug. 15, 2002

(30) Foreign Application Priority Data

Feb. 12, 2001 (EP) ..... 01103248

(51) Int. Cl.[7] ..... B21F 9/02
(52) U.S. Cl. ..... 140/123; 140/93.2
(58) Field of Search ..... 140/123, 123.6, 140/93.2; 29/809, 811.2

(56) References Cited

U.S. PATENT DOCUMENTS 4,371,010 A * 2/1983 Hidassy ..... 140/123.6
4,610,067 A 9/1986 Hara ..... 140/93.2
4,908,911 A * 3/1990 Bretti et al. ..... 140/123.6
5,167,265 A * 12/1992 Sakamoto ..... 140/93.2
5,595,220 A * 1/1997 Leban et al. ..... 140/123.6
5,778,946 A * 7/1998 Pellenc et al. ..... 140/119

FOREIGN PATENT DOCUMENTS

EP 0 297 337 A1 1/1989
EP 0 303 723 B1 2/1989
EP 0 565 968 A2 10/1993

* cited by examiner

*Primary Examiner*—Daniel C. Crane
(74) *Attorney, Agent, or Firm*—Alix, Yale & Ristas, LLP

(57) ABSTRACT

The arrangement for binding objects (6) by means of a band (5), the ends of which are retained by a lock (4), having a magazine for a chain (11) of interconnected locks (12), a tool (1) with a guide channel (14) for the chain (11) of locks (12), a conveying connection (10) from the magazine to the guide channel (14), a tool drive (29) and a conveying drive. The conveying drive provided according to the invention is a spring (33) which can be subjected to stressing by an electric tool drive (29). This has the advantage that a high advancement force can be produced even when a relatively low-power drive motor is used.

17 Claims, 3 Drawing Sheets

ARRANGEMENT FOR BINDING OBJECTS BY MEANS OF A BAND LOOP

BACKGROUND OF THE INVENTION

Figure 1:
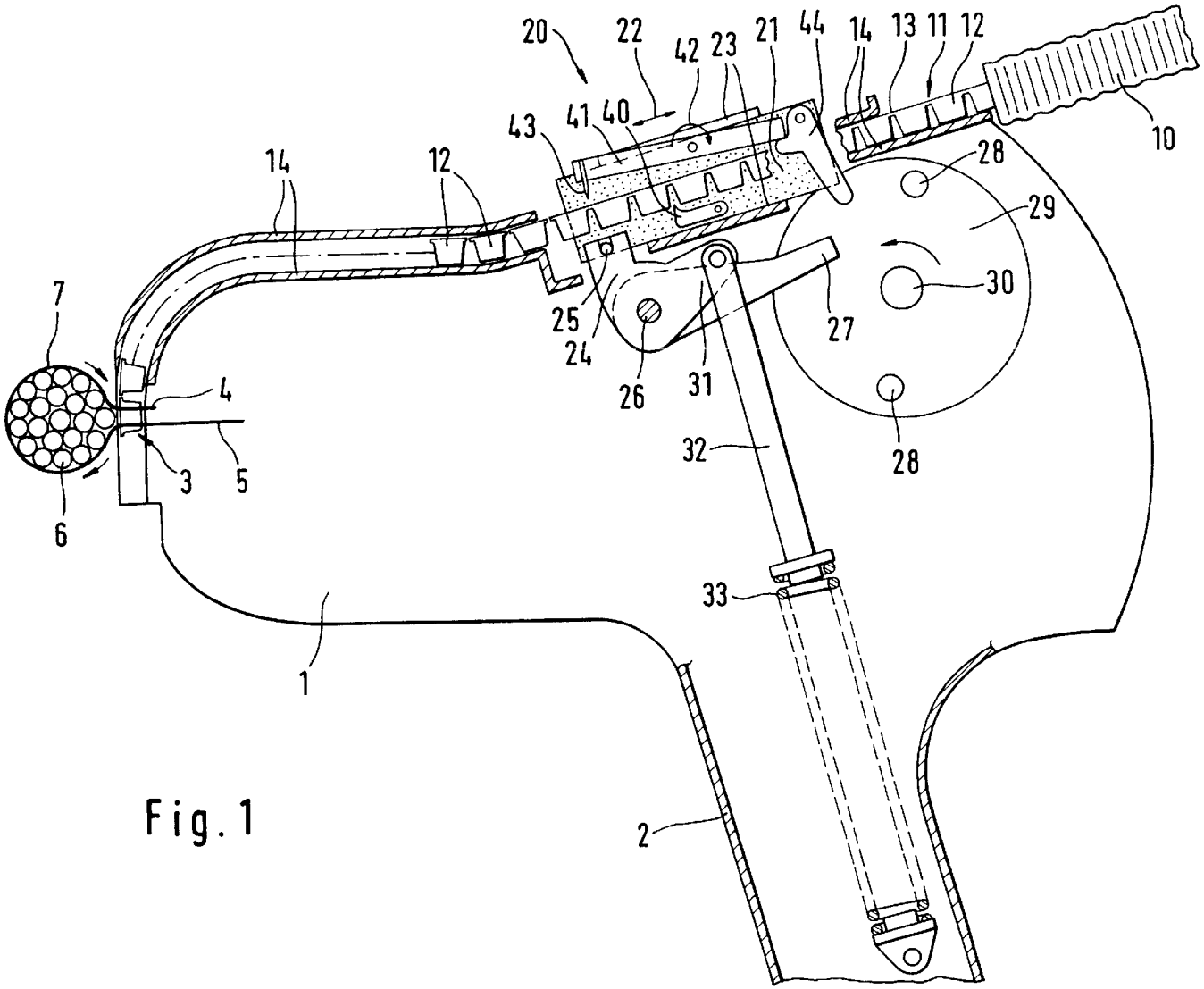

It is known for objects to be bound by means of a band which is positioned as a loop around the object, the ends of said loop then being fixedly connected to one another by a lock. If a large number of binding operations are to be carried out at a workstation, as is the case, for example, in the production of cable harnesses, use is made of largely automatically operating tools which are assigned magazines for the locks and the band. Whereas small magazines may be arranged on the tool itself, large magazines are kept stationary. In order for it to be possible for the locks to be fed to the tool from such stationary magazines, the locks are designed as a more or less endless lock chain by the individual locks being retained, for example, on a carrier strip or being connected directly to one another by material crosspieces which are severed before the individual lock is used. In the case of known tools, the conveying path for the lock chain between the magazine and tool is formed by a flexible tube. If the connection between the individual locks is firm enough, it may be possible, if appropriate, to dispense with the protection given by such a flexible tube. The conveying path is then formed by the lock chain as such. In each case, considerable forces may be necessary in order to move the lock chain up into the tool if, for example, the flexible tube forming the conveying path is curved or the lock chain, before it passes into the tool, is angled in relation to the guide channel accommodating it in the tool. In the case of known tools, a pneumatic drive is provided for this purpose. This has the property of comparatively large forces being available for brief driving tasks, as occur during the brief advancement of the lock strip between two binding operations. A pneumatic drive, however, has disadvantages in comparison with an electric drive, for example in respect of the weight and the dimensions of the tool and the pressure-medium feed. It is also the case that the energy consumption and the noise development are unfavourable in pneumatic tools. Electric drives on binding tools are also known. However, if they are not likewise to be heavy and bulky, these have the disadvantage that they cannot supply high power for a brief period, which is required for moving the lock chain up into the tool. For a demonstration of the prior art, you are referred to the brochure entitled "Automatische Bündel-und Verschluβwerkzeuge [Automatic bundling and closure tools] Autotool/Tytontool" from Paul Hellermann GmbH, EP-B 303723, EP-B 565968 and U.S. Pat. No. 4,610,067. In the case of EP-A 297 337 and EP-A 565 968, the advancement is brought about by the actuation of a hand lever.

Taking as the departure point the prior art mentioned in the preamble of claim 1, namely the abovedescribed brochure, the object of the invention is to make it possible to use an electric drive in the case of tool arrangements with a stationary lock magazine. The solution according to the invention resides in the features of claim 1 and preferably those of the subclaims.

SUMMARY OF THE INVENTION

Provision is accordingly made for the conveying drive provided to be a spring which can be subjected to stressing by the electric tool drive. The spring may easily be dimensioned such that it applies the necessary advancement forces. It may also be subjected to stressing by a low-torque motor, because all that this requires is suitable dimensioning of a reduction gear mechanism located between the motor and the spring.

Expediently provided for the purpose of subjecting the lock chain to the advancement force is an advancement engagement element which is arranged on the guide channel of the tool and is guided such that it can be moved in the direction thereof. The advancement engagement element is subjected to loading in the advancement direction exclusively by the spring during the advancement phase. In another part of the operating cycle, namely when a binding operation has been completed and a new lock has to be provided, it is connected to a restoring means which is moved counter to the advancement direction by the tool drive. Said restoring means moves the advancement engagement element back by at least the longitudinal dimension of a lock, in order that it can engage with the following lock in the subsequent advancement operation.

The restoring means is expediently a rotary cam, because such an element is straightforward to provide in design terms and can easily be engaged with, and disengaged from, the advancement engagement element or an interposed transmission element. Such a transmission element between the rotary cam and the advancement engagement element is designed, according to the invention, as a multi-armed lever, of which one lever arm interacts with the rotary cam, while a second lever arm is connected to the spring and a third lever arm is connected to the advancement engagement element. The arrangement may also be such that one lever arm performs a number of the functions which have just been specified.

In a particularly preferred embodiment, the rotary cam periodically passes into the pivoting region of the lever arm assigned to it and also leaves said pivoting region again. As soon as the rotary cam engages with the lever arm, it rotates it in such a way that the spring is subjected to stressing and the advancement engagement element is retracted. As soon as it leaves the pivoting region of the lever arm, the spring, and thus the conveying drive, is disengaged. The advancement engagement element engages with the next lock and moves the latter forwards. Since this lock is fixedly connected to the lock chain following it, the latter is likewise moved up.

The spring force is preferably then maintained in order for the lock located in front of the advancement engagement element, as seen in the advancement direction, or the foremost lock of the number of locks located in front of the same, to be forced into that position in which it is ready for the following binding operation and in order for it, if appropriate, also to be retained in this position.

According to a particular feature of the invention, which possibly merits protection independently of the features explained above, the advancement engagement element is arranged on a carriage which is guided such that it can be moved essentially parallel to the guide channel, and which is also equipped with a device for separating the locks from one another. This is based on the idea that the as yet unseparated locks located in the vicinity of the advancement engagement element are positioned very precisely in relation to the advancement engagement element, and a separating device, the position of which is fixed in relation to the advancement engagement element, can thus carry out the separating operation at a very precisely determinable location of the lock chain. This is important, in particular, in the cases in which the locks are connected to one another by very short crosspieces, which have to be cut in a correspondingly precise manner.

BRIEF DESCRIPTION OF THE PREFERRED EMBODIMENT

Figure 2:
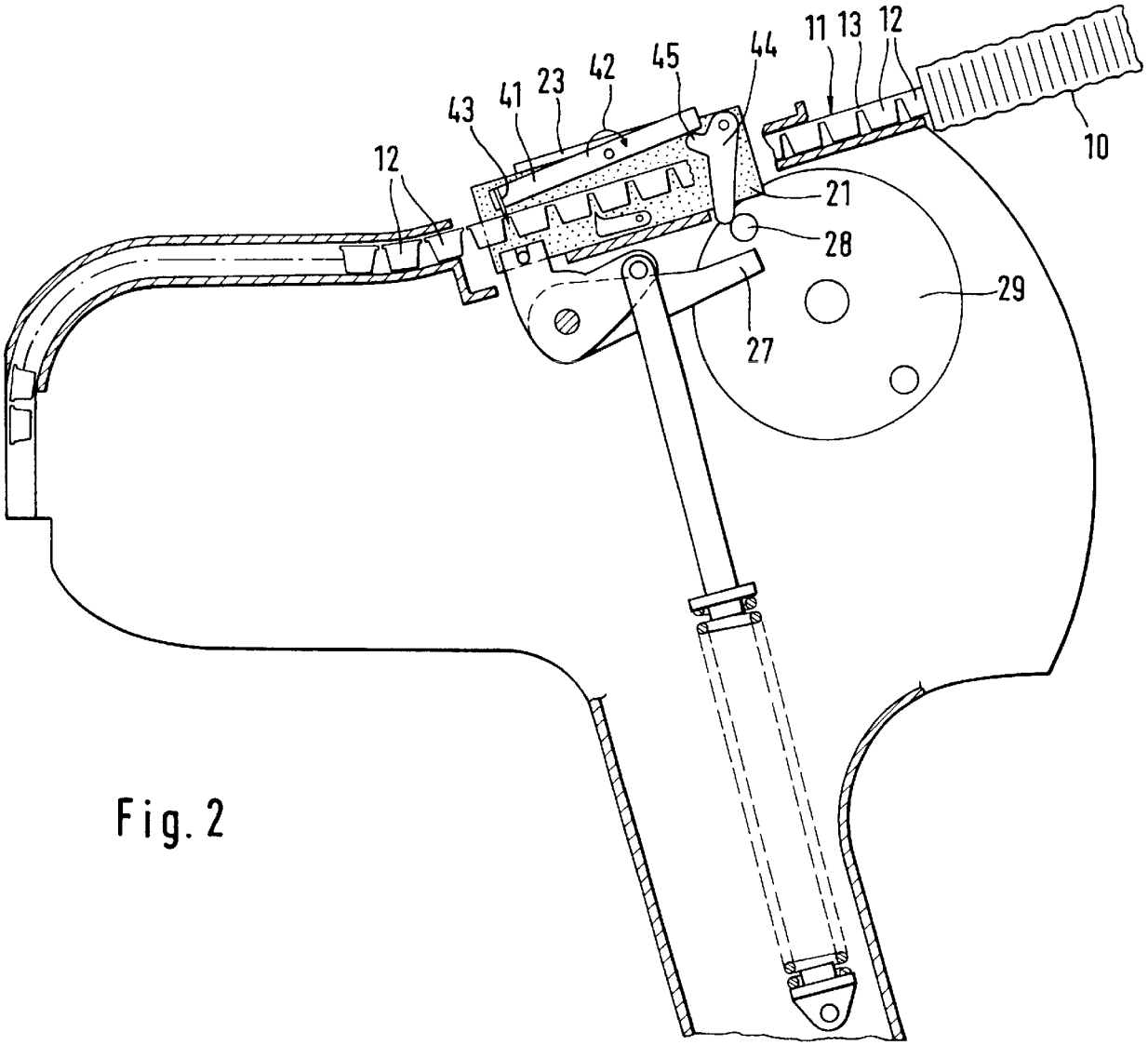
Figure 3:
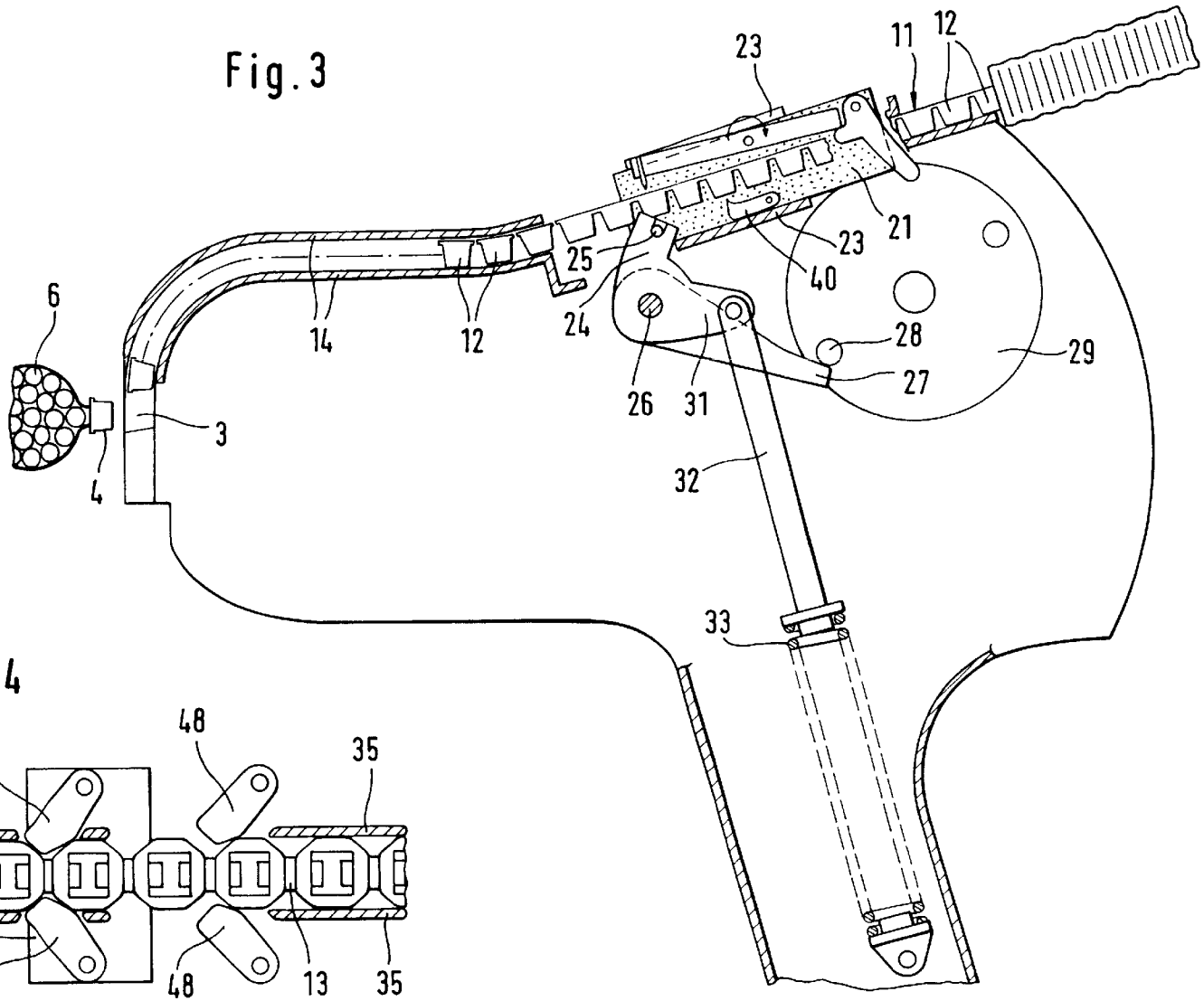
Figure 4:
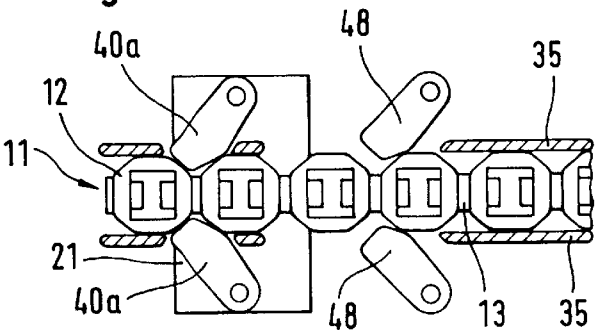

The invention is explained in more detail hereinbelow with reference to the drawing, which illustrates an advantageous exemplary embodiment and in which:

FIGS. 1 to 3 show three schematic longitudinal sections through the tool at different functional stages, and FIG. 4 shows a view of the detent arrangement on the carrier.

DETAILED DESCRIPTION OF THE PREFERRED EMBODIMENT

The tool body 1, with a handle 2, has, on its end side, a mount (not illustrated in any more detail) for a lock 4 through which, by means which are not of any interest in this context, a band 5 is guided in the direction of the arrows, tied, in the form of a loop 7, around an object 6 which is to be bound, and guided back into the lock 4 by way of its free end. Thereafter, the band 5 is tensioned, the protruding end is cut off and the lock 4 is released from the lock mount 3 (FIG. 3).

In order to allow largely automatic operation, the locks which are to be processed are fed automatically to the lock mount 3. From a large stationary magazine (not illustrated), they are guided to the tool body 1 through a flexible tube 10 in the form of a lock chain 11, in which the individual locks 12 are connected integrally to one another by crosspieces 13. At the tool body, the lock chain 11 is accommodated by a guide channel 14, which opens out at the lock mount 3.

Provided on the guide channel 14 is a device 20 for advancing and separating the locks. The illustration of the guide channel 14 has been interrupted in the region of this device 20. It goes without saying, however, that a guide for the lock chain 11 is also provided in this region. Parallel to said lock guide, a carriage 21, which is illustrated in the drawing by dots, is mounted such that it can be moved in the arrow direction 22. Two guide walls 23 indicate the carriage guide schematically. Provided for driving the carriage is a lever arm 24 which interacts with the carriage 21 in a suitable manner at 25 and can be pivoted about a pin 26 which is fixed on the tool body 1. It is rigidly connected to a cam lever 27 which projects into the circulatory path of two cams 28, which are arranged on a cam disc 29 which is driven in rotation about the pin 30 by an electric motor.

Rigidly connected to the lever arms 24, 27 is a third lever arm 31, the end of which is articulated on the connecting rod 32 of a compression spring 33. The spring 33 forces the lever arm 31 upwards (in the drawing) and thus forces the end of the lever arm 24 in the direction of the end of the tool. If, in contrast, a cam 28 engages with the cam lever 27, as is illustrated in FIG. 3, the cam lever 27 is forced downwards. The lever arm 31 is also moved downwards at the same time, as a result of which the spring 33 is subjected to stressing. The lever arm 24 and, with it, the carriage 21 are moved to the right (in the drawing), that is to say counter to the advancement direction of the lock chain 11. The rotary cam 28 thus forms the abovementioned restoring means for the carriage 21. When the cam 28 has passed the cam lever 27, the spring 33 tries to pivot the lever arrangement 24, 27, 31 in the anti-clockwise direction and thus to move the carriage 21 in the advancement direction.

A detent 40 is articulated, as advancement engagement element, on the carriage 21. It is designed and arranged such that its tip is forced into engagement with the lock chain 11 by a spring which is not shown. In more general terms, the detent 40 has a surface which can engage with a rearwardly oriented surface of a lock in order to subject the latter to an advancement force.

Also articulated on the carriage 21 is a rocker 41, which is forced in the arrow direction 42 by a spring which is not illustrated. The rocker bears, at its front end, a blade 43 which is intended, during movement counter to the arrow direction 42, to sever a crosspiece 13 between successive locks 12. In order to bring about this cutting movement of the rocker 41, a cam lever 44 is provided, thus intercepting the rear end of the rocker 41 by way of a nose 45. The bottom end of the cam lever projects into the circulatory path of the rotary cam 28. If it is intercepted by a rotary cam according to FIG. 2, then the pivot lever 44 is pivoted in the clockwise direction and the rocker 41 is pivoted counter to the arrow direction 42. The blade 43 executes the cut in the process. In the embodiment illustrated, the cam lever 44 is articulated on the carriage. Instead of this, it is also possible for it to be fitted on the tool body, as long as it is ensured that it interacts with the rocker.

The detent 40 is designed such that it always interacts with the locks 12 in the same way. The lock intercepted by the detent 40 in each case is thus located in a precisely defined position in relation to the detent. Arranging the detent 40 and the blade 43 at a fixed distance from one another on the carriage 21, and always providing the locks with the same configuration and spacing them apart from one another by the same distance, ensures that the blade 43 always comes into contact with the crosspiece 13 precisely between two successive locks 12. This would not be ensured if the cutting device were arranged on the housing on the tool body because the respective position of the carriage in relation to the tool body is indeterminate, as can be gathered from the later description of the functioning.

Since the illustration of the blocking mechanism in FIGS. 1 to 3 is very schematic, FIG. 4 illustrates how the practical embodiment is expediently configured. The carriage 21 is arranged on both sides of the lock chain 11 and forms guides 35 for the latter. On both sides of the lock chain 11, the carriage bears in each case one detent 40*a* which is forced, by a spring which is not shown, from the side into the expediently wedge-shaped interspace between two locks 12. This achieves defined positioning of the locks. Fixed on the tool housing is a further pair of detents 48, which are likewise forced against the locks by spring force and ensure that the lock chain is secured when the carriage 21 moves back (FIG. 3). The object 6 is being bound by means of the loop 7 in FIG. 1.

In this state, the spring 33 subjects the carriage 21, via the lever arrangement 31, 24, to an advancement force, which is transmitted to the lock chain 11 via the detent 40. The foremost lock 4 is consequently forced reliably into the lock mount 3, the position of the carriage 21 being determined by the length of the locks which are located between the foremost lock 4 and the detent 40, and on which the carriage is supported under the spring force 33. Since this series of locks located in front of the carriage 21 comprises separated locks, the distance between which does not necessarily coincide with the distance between them before they are separated, the position of the carriage 21 in this state is subjected to random fluctuations within a certain tolerance framework. This is the reason why the cutting device 43, together with the detent 40, is arranged on the carriage 21.

The cam disc 29 rotates continuously in the arrow direction during the operating cycle of the tool. When the binding operation has been completed, a cam 28 reaches the bottom end of the cam lever 44 and pivots the latter according to FIG. 2, as a result of which the last lock located in the carriage is separated off from the rest of the series of locks. When the cam 28 has left the cam lever 44, the latter, together with the rocker 41, pivots back again, under the spring force 42, into the position according to FIGS. 1 and 3.

The cam 28 then reaches the end of the cam lever 27 and thus pivots the cam arrangement in the clockwise direction. As a result, the spring 33 is subjected to stressing and the carriage 21 is displaced rearwards (to the right in the drawing) by somewhat more than the dimension of one lock (FIG. 3). During this rearward displacement, the detents 48 (FIG. 4) secure the series of locks. In this case, the detent 40 slides (or the detents 40*a* slide) along a lock, beyond the rear surface of the latter, it being the intention for said rear surface to be intercepted during the next advancement. As soon as the cam 28 has left the end of the cam lever 27, the carriage 21 moves in the advancement direction under the action of the spring 33. In this case, first of all, the detent 40 engages (or the detents 40*a* engage) in the nearest lock gap. As soon as the bound object 6 has been removed from the tool along with the foremost lock 4, and the lock mount is thus empty, the carriage 21 is moved on together with the lock chain until the now foremost lock has reached the lock mount 3. The resistance confronting this lock in the lock mount is transmitted to the detent 40 and the carriage 21 via the rest of the lock chain and secures said carriage. In this case, the lock chain located in front of the carriage is constantly subjected to the force of the spring 33 and/or the advancement force of the carriage 21.

Since the lock in front of the detent 40 is still connected integrally to the following chain of locks, said chain is also moved up correspondingly.

The invention has the advantage that, despite a relatively low-power drive, it is possible to apply the force which is necessary for moving up and advancing the lock chain. A further advantage is that the lock due for processing is secured reliably in the lock mount by the spring force. A further advantage is that the cut separating successive locks can take place at a very precisely defined location and, accordingly, the length of the crosspiece 13 which connects successive locks may be very short, namely short enough for the residues remaining on the locks not to pose any risk of injury. They need not be removed. The locks are thus separated without any waste being produced. Finally, it is an advantage of the invention that the locks can be separated at any desired, considerable distance from the end of the tool, where the task of accommodating a cutting device for the locks is problematic in respect of space.

What is claimed is:

1. An arrangement for binding objects by means of a band, the ends of which are retained by a lock, the arrangement comprising a stationary magazine for a chain of interconnected locks, a tool with an operating cycle and having a guide channel for the chain of locks, a conveying connection from the magazine to the guide channel, a tool drive and a conveying drive, wherein the conveying drive comprises a spring which is subjected to stressing by the tool drive during a portion of the operating cycle.

2. The arrangement as claimed in claim 1, wherein the tool drive (29) comprises an electric torque motor.

3. The arrangement as claimed in claim 1, wherein an advancement engagement element is arranged on the guide channel to advance the lock chain and said advancement engagement element is guided such that it can be moved parallel to the guide channel in an advancement and counter advancement direction, and said advancement engagement element being subjected to loading by the spring in the advancement direction part of the operating cycle of the tool and, said advancement engagement element in another part of the operating cycle, is connected to a restoring means and is moved counter to the advancement direction by the tool drive, said tool drive tensions the spring as said advancement engagement element is moved counter to the advancement direction.

4. The arrangement as claimed in claim 3, wherein the restoring means is a rotary cam.

5. The arrangement as claimed in claim 4, wherein arranged between the rotary cam (28) and the advancement engagement element (40) is a multi-armed lever (24, 27, 31), of which one lever arm (27) interacts with the rotary cam, a second lever arm (31) is connected to the spring (33) and a third lever arm (24) is connected to the advancement engagement element (40).

6. The arrangement as claimed in claim 5, wherein the rotary cam leaves a pivoting region of the lever arm assigned to it, and thus disengages the conveying drive.

7. The arrangement as claimed in claim 1, wherein an advancement engagement element is arranged on a carriage which is guided such that it can be moved parallel to the guide channel, and said carriage is also equipped with a device for separating the locks from one another.

8. The arrangement according to claim 7, wherein the locks in the chain are connected to one another by crosspieces, and the separating device is a cutting device.

9. The arrangement as claimed in claim 2, wherein an advancement engagement element is arranged on the guide channel, to advance the back chain and said advancement engagement element is guided such that it can be moved parallel to the guide channel in an advancement and counter advancement direction, and said advancement engagement element being subject to loading by the spring in the advancement direction part of the operating cycle of the tool and, in another part of the operating cycle, said advancement engagement element is connected to a restoring means and is moved counter to the advancement direction by the electric torque motor, said electric torque motor tensions the spring as said advancement engagement element is moved counter to the advancement direction.

10. The arrangement as claimed in claim 1, wherein an advancement engagement element is arranged on a carrier to advance the lock chain, and said carrier is guided such that it can be moved parallel to the guide channel, and is also equipped with a device for separating the locks from one another.

11. The arrangement as claimed in claim 3, wherein an advancement engagement element is arranged on a carrier to advance the lock chain and said carrier is guided such that it can be moved parallel to the guide channel, and is also equipped with a device for separating the locks from one another.

12. The arrangement as claimed in claim 11, wherein the advancement engagement element is arranged on a carrier to advance the lock chain and said carrier is guided such that it can be moved parallel to the guide channel, and is also equipped with a device for separating the locks from one another.

13. The arrangement as claimed in claim 11, wherein the restoring means is a rotary cam.

14. The arrangement as claimed in claim 6, wherein the advancement engagement element is arranged on a carrier which is guided such that it can be moved parallel to the guide channel, and which is also equipped with a device for separating the locks from one another.

15. The arrangement as claimed in claim 11, wherein the restoring means is a rotary cam.

16. An arrangement for binding objects by means of a band, the ends of which are retained by a lock, the arrangement comprising:

a magazine for a chain of interconnected locks;

a tool with a guide channel for the chain of locks, an electric tool drive and a conveying drive, wherein the conveying drive comprises a spring which can be subjected to stressing by the tool drive, an advancement engagement element arranged on the guide channel, said advancement engagement element is guided such that it can be moved, said advancement engagement element being subjected to loading in an advancement direction exclusively by the spring during part of the operating cycle of the tool and, in another part of the operating cycle, said advancement engagement element is connected to a rotary cam, and is moved counter to the advancement direction by the tool drive; and a conveying connection from the magazine to the guide channel.

17. The arrangement as claimed in claim 10, wherein the advancement engagement element is arranged on a carrier which is guided such that it can be moved parallel to the guide channel, and which is also equipped with a device for separating the locks from one another.

* * * * *

UNITED STATES PATENT AND TRADEMARK OFFICE

CERTIFICATE OF CORRECTION

PATENT NO. : 6,640,839 B2
DATED : November 4, 2003
INVENTOR(S) : Thieme

It is certified that error appears in the above-identified patent and that said Letters Patent is hereby corrected as shown below:

Column 5,
Line 62, delete "(29)".

Column 6,
Line 13, delete "(28)";
Line 14, delete "(40)" and delete "(24, 27, 31)"
Line 15, delete "(27)";
Line 16, delete "(31)" and delete "(33)";
Line 17, delete "(24)"; and
Line 18, delete "(40)".
Line 55, delete "11" and insert therefor -- 9 --.

Column 7,
Line 1, delete "11" and insert therefor -- 12 --.

Column 8,
Line 9, delete "10" and insert therefor -- 16 --.

Signed and Sealed this

Tenth Day of May, 2005

JON W. DUDAS
*Director of the United States Patent and Trademark Office*